US006793203B2

(12) United States Patent
Heinrichs et al.

(10) Patent No.: US 6,793,203 B2
(45) Date of Patent: Sep. 21, 2004

(54) HOISTING GEAR

(75) Inventors: Peter Heinrichs, Wegberg (DE); Albrecht Heinrichs, Erkelenz (DE)

(73) Assignee: Wirth Maschinen- Und Bohrgerätefabrik GmbH, Erkelenz (DE)

( * ) Notice: Subject to any disclaimer, the term of this patent is extended or adjusted under 35 U.S.C. 154(b) by 7 days.

(21) Appl. No.: 10/220,367

(22) PCT Filed: Feb. 14, 2001

(86) PCT No.: PCT/EP01/01613

§ 371 (c)(1),
(2), (4) Date: Oct. 17, 2002

(87) PCT Pub. No.: WO01/64573

PCT Pub. Date: Sep. 7, 2001

(65) Prior Publication Data

US 2003/0111653 A1 Jun. 19, 2003

(30) Foreign Application Priority Data

Feb. 28, 2000 (DE) ..... 200 03 513 U

(51) Int. Cl.[7] ..... B66D 1/14; B66D 1/12
(52) U.S. Cl. ..... 254/342; 254/362
(58) Field of Search ..... 254/274, 275, 254/342, 347, 362, 346

(56) References Cited

U.S. PATENT DOCUMENTS

| | | | | | |
|---|---|---|---|---|---|
| 3,608,864 | A | * | 9/1971 | Dargitz et al. | 254/274 |
| 4,434,971 | A | | 3/1984 | Cordrey | |
| 4,842,250 | A | * | 6/1989 | Willis et al. | 254/337 |
| 5,039,028 | A | * | 8/1991 | Svedlund et al. | 254/275 |
| 5,141,085 | A | * | 8/1992 | McCormick | 188/82.1 |
| 5,167,400 | A | * | 12/1992 | Gazel-Anthoine | 254/275 |
| 5,368,279 | A | * | 11/1994 | Ottemann et al. | 254/342 |

FOREIGN PATENT DOCUMENTS

| | | |
|---|---|---|
| DE | 696076 | 9/1940 |
| DE | 739553 | 9/1943 |
| GB | 876647 | 10/1959 |

* cited by examiner

*Primary Examiner*—Kathy Matecki
*Assistant Examiner*—Evan H Langdon
(74) *Attorney, Agent, or Firm*—Friedrich Kueffner

(57) ABSTRACT

The lifting gear includes a rotatably mounted drum (5) for winding up tension means (4), which is driven in rotation by at least one rotary driving device (19) comprising a rotary driving motor (21) acting on the drum (5) through at least one change-speed gearbox (25). The at least one rotary driving device (19) is—in relation to the axis of rotation (S) of the drum (5)—arranged alongside the drum (5) in such a way that the drum (5) and the rotary driving device (19) at least partially overlap in a projection perpendicular to the axis of rotation (S) of the drum (5).

9 Claims, 3 Drawing Sheets

HOISTING GEAR

BACKGROUND OF THE INVENTION

The invention relates to lifting gear for raising and lowering a load.

Such lifting gear serves for raising and lowering a load, in particular drilling equipment, for example from a platform into a bore hole or onto the seabed. It comprises flexible tension means, of which one end is attached to the drilling equipment. The other end of the tension means is attached to a rotatably mounted winding drum by which the tension means can be wound up and unwound.

At least one rotary driving device is provided for driving the drum. The device usually incorporates a direct current motor. In order to be able to drive the drum over a relatively wide speed range with almost constant high power, there is connected to the direct current motor a change-speed gearbox, of which the input shaft is coupled to the motor and the output shaft to the drum.

In a first embodiment of such known lifting gear the torque which is available is transmitted to the drum by means of a roller-link driving chain. It is true that these so-called chain drives have relatively compact external dimensions, but there is a drawback in that the slack always present in the lower run of the chain drive in so-called "four-quadrant operation", in which the load can be both accelerated and also braked both on raising of the load and also on lowering it, can switch to the upper run and thereby produce a sudden shock-like operation with substantial peak loads acting on the tension means. A significant danger lies in this, since the tensile strength of the tension means can be exceeded by these peak loads, which can lead to failure of the tension means, with the associated catastrophic consequences.

There is therefore known, from Messrs Wirth Maschinen- und Bohrgerate-Fabrik GmbH of Erkelenz, lifting gear including two drive units each comprising a direct current electric motor with associated change-speed gearbox, in which the gearbox output shafts each carry a respective toothed gear pinion which engages a gearwheel secured on the shaft of the drum. The two rotary driving devices are mounted side by side on an extension of the axis of the drum at one of the end faces of the drum in such a way that the engagements of the two pinions with the gearwheel mounted on the shaft of the drum are offset through 180° with respect to the axis of the drum. On the far side, at the other end face of the drum are provided, one following the other looking along the axis of the shaft, a disc brake and an eddy-current brake secured to the shaft of the drum.

Using this gear-driven lifting equipment—in contrast to the chain-driven lifting gear—it is possible to provide "four-quadrant operation" without this leading to unwanted peak loads in the tension means. Through the possibility of using the driving motors also for braking the rotation of the drum, through the possibility of feeding back directly the electrical energy recovered in the braking process, a substantial saving in energy can be achieved. Furthermore the mechanical disc brake arrangement only comes into use substantially less frequently than in the case of the chain-driven lifting gear, whereby on the one hand the wear to which it is subjected and the down times of the lifting gear resulting from wear, and on the other hand the noise penalties regularly arising with mechanical brakes, are reduced to a minimum.

In fact this gear-driven lifting equipment has proved itself many times in recent years, but the substantial amount of space that it takes up makes it unsuitable in particular for simply replacing the more compact chain-driven lifting gear.

It is known that alternating current rotary driving electric motors have a higher torque over a wider speed range than direct current motors. Accordingly it has become known to equip gear-driven lifting equipment of the kind described above with alternating current electric motors without change-speed gearboxes as a replacement for direct current electric motor/gearbox units, since in this way the structural length of the lifting gear is reduced. However a significant drawback lies in the fact that, in particular when the gear-driven lifting equipment is to be introduced in exchange for a direct current chain-driven lifting gear, the whole electrical installation must be changed over from direct current to alternating current, which generally involves an outlay which is not economically sustainable.

SUMMARY OF THE INVENTION

The invention is therefore based on solving the problem of providing lifting gear with which four-quadrant operation is possible but which uses direct current and of which the structural length is reduced.

Pursuant to the invention, at least one rotary drive device is arranged alongside the drum in relation to the axis of rotation of the drum in such a way that the drum and the rotary drive device partially overlap one another in a projection perpendicular to the axis of rotation of the drum. Due to this construction, the structural strength of the lifting gear is significantly reduced. The length of the lifting gear is accordingly determined substantially by the drum and the assemblies which are connected ahead of it and following it in the direction of the axis of the drum.

In a preferred embodiment of the lifting gear according to the invention the driving shaft of the driving motor and the input and output shafts of the gearbox are arranged to lie on a common straight line. Any change of direction of the driving torque which would involve an increased outlay and also power loss is thereby avoided.

The drum is preferably secured to a rotatably mounted drum shaft to rotate with it.

The drum shaft is then preferably connected to the output side of a gearbox unit of which the input side is coupled to the output shaft of the change-speed gearbox.

The gearbox unit is preferably a toothed gear drive which has an idler pinion between output shaft of the change-speed gearbox and the shaft of the drum to bridge the gap between them.

If the drum shaft is coupled at one end to a mechanically acting braking device and at the other end to an electrically acting braking device, then in case of need a high braking torque can be exerted on the drum by operating both braking devices simultaneously without this leading to torsion forces being applied to only one end of the drum shaft, as would be the case if only one end of the drum shaft were coupled to braking devices.

The mechanically acting braking device is preferably a disc brake and the electromagnetically acting braking device is an eddy-current brake.

To increase the torque which can be transmitted to the drum shaft and to achieve emergency running characteristics the lifting gear according to the invention preferably has a second rotary driving device with a rotary driving motor and change-speed gearbox.

In this arrangement the drive shaft of the rotary driving motor and the input and output shafts of the change-speed gearbox of the second rotary driving device are arranged to lie on a common straight line which—and this is particularly preferred—coincides with the axis of rotation of the output shaft of the change-speed gearbox of the first rotary driving arrangement.

The output shafts are preferably both coupled directly to the input side of the gearbox unit, which can be structurally modified so that they are both operatively connected to the same gearbox input pinion.

If the second rotary driving device—looking in the direction of the axis of rotation of the electromagnetically acting braking device—is mounted alongside this braking device, the structural length of this lifting gear equipped with two rotary driving devices is increased either not at all or only insignificantly.

To avoid overloading the driving motors of the rotary driving devices, the change-speed gearboxes are preferably equipped with a safety device which, in the event of a maximum permissible torque at the input shaft of the gearbox being exceeded, automatically change gear to the ratio having the greatest ratio of the speed of the input shaft to the speed of the output shaft.

BRIEF DESCRIPTION OF THE DRAWING

An embodiment of the invention by way of example is illustrated in the drawings. In these.

DETAILED DESCRIPTION OF THE INVENTION

Figure 1:
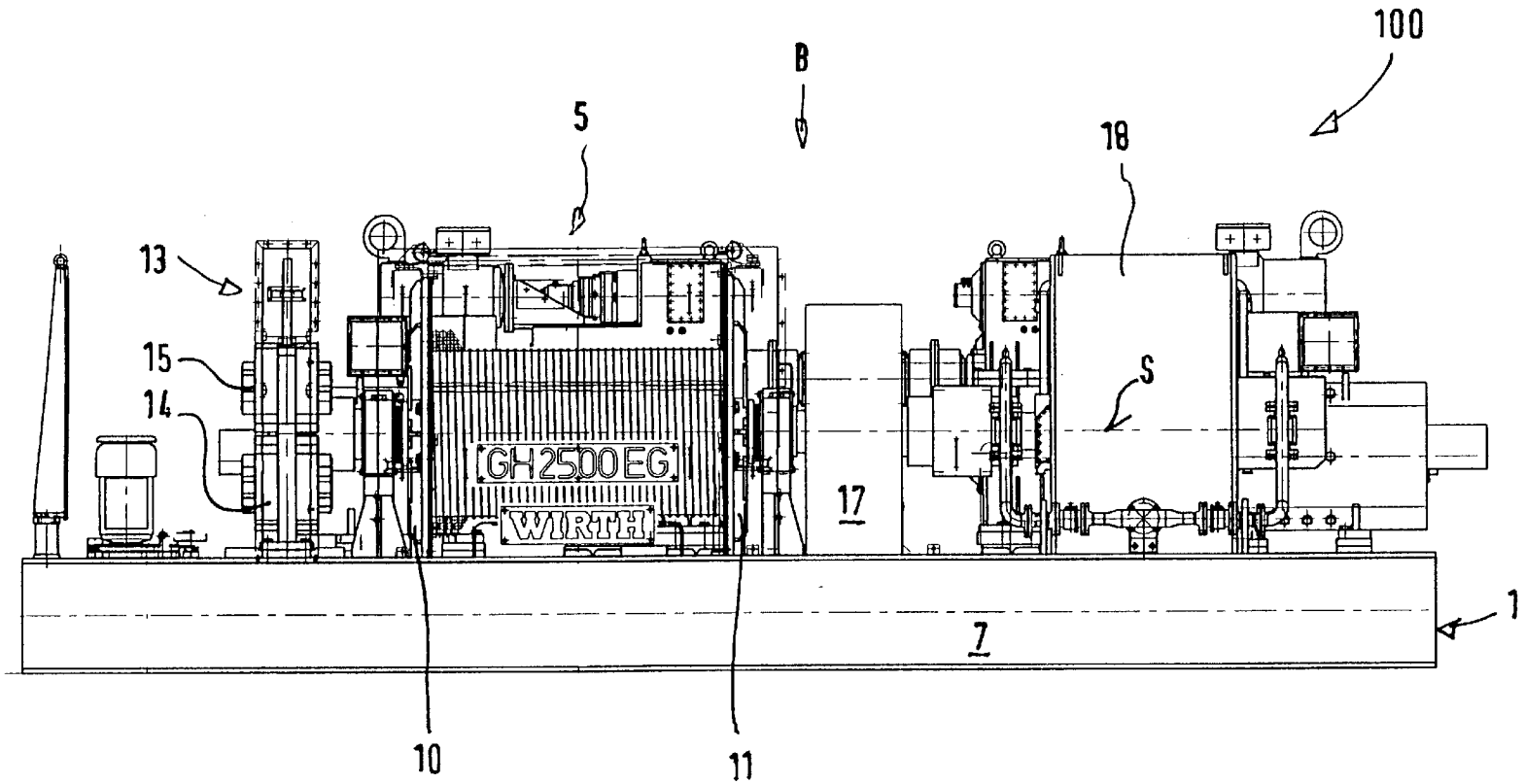
FIG. 1 shows a side view of one embodiment of lifting gear according to the invention (view A in FIG. 2)
Figure 2:
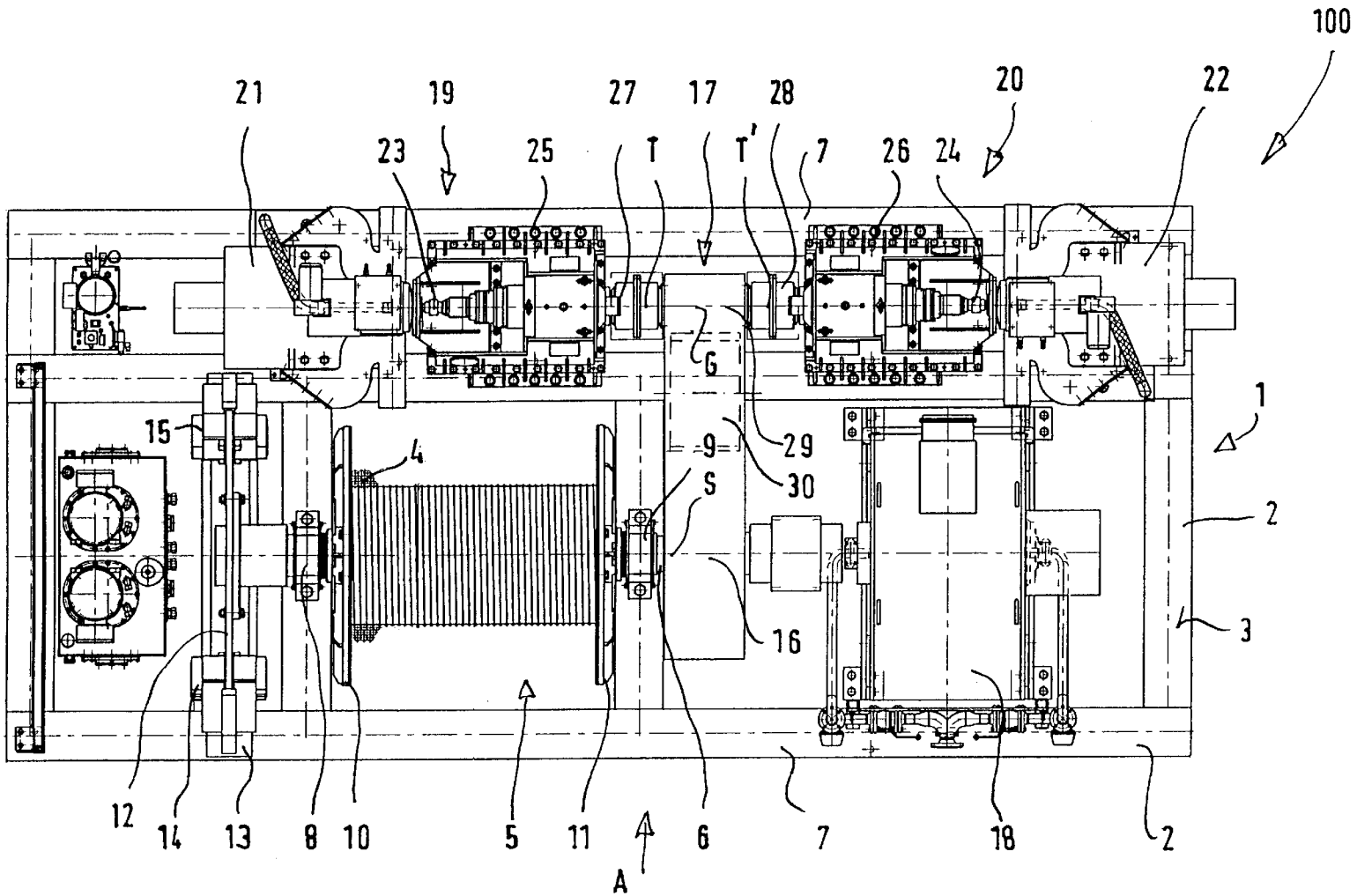
FIG. 2 shows the same lifting gear as in FIG. 1, looking from above (view B in FIG. 1)
Figure 3:
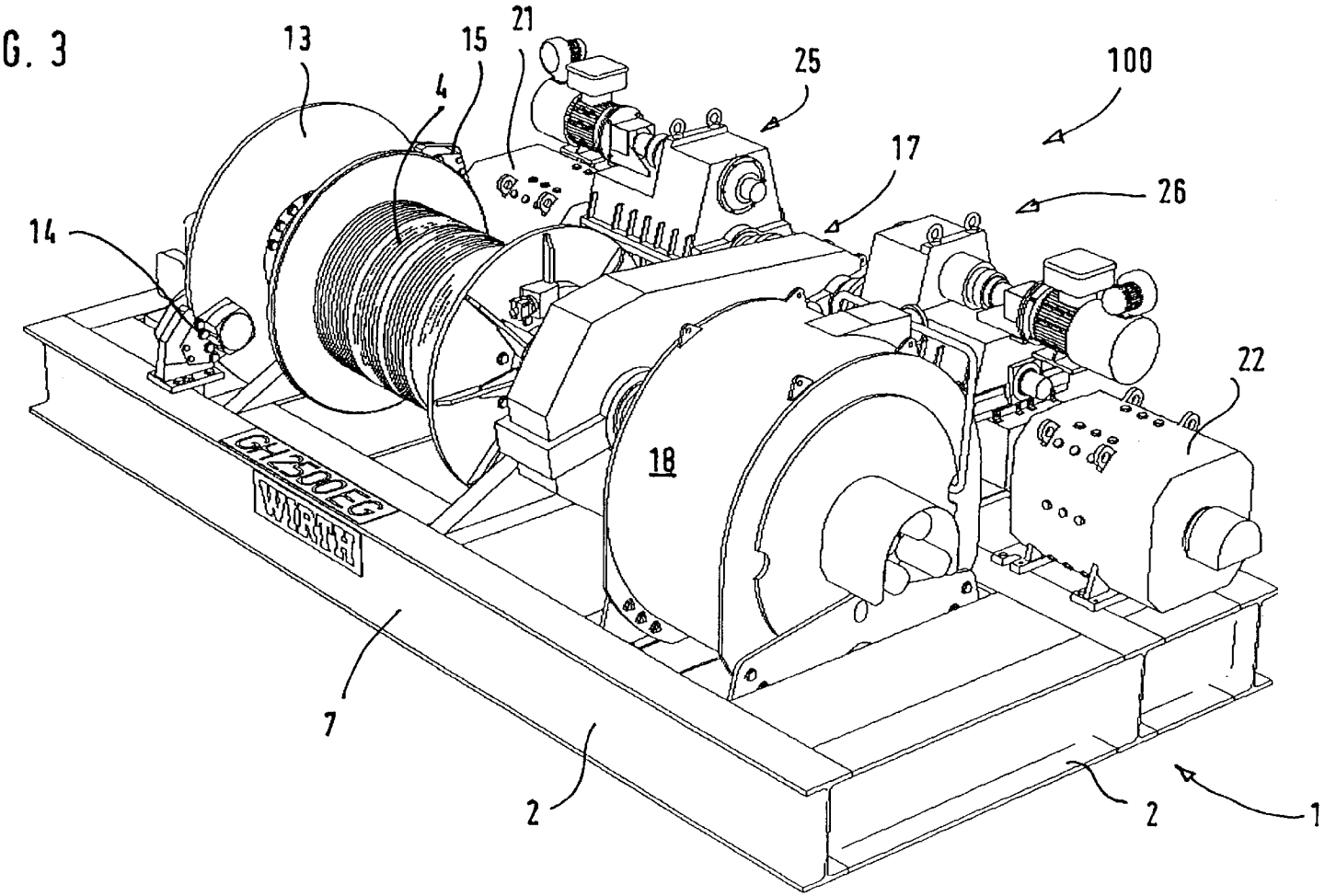
FIG. 3 is a perspective view of the same lifting gear.

The lifting gear indicated as a whole at 100 comprises a frame 1 of rectangular outline, made up of I-section steel beams 2 welded together. Bolted to the upper horizontal surfaces 3 of the beams 2 are the components of the lifting gear described below.

For raising and lowering drilling equipment the lifting gear 100 includes flexible tension means 4 in the form of a steel rope which can be wound up on, and unwound from, a drum 5.

The drum 5 is secured on a drum shaft 6, of which the axis S runs parallel to the longer sides 7 of the frame 1. It is carried in bearing blocks 8, 9, which are arranged on each side of the two end faces 10, 11 of the drum 5. The left-hand end of the drum shaft 6 as viewed in the drawing is secured to the disc 12 of a disc brake assembly 13, which has two brake calipers 14, 15 offset by 180° about the axis S in the direction of rotation. By means of the disc brake assembly 13 the speed of rotation of the drum 5 during the process of unwinding the flexible tension remains 4 can be braked or brought to a complete halt. On the other side of the other face 11 the drum shaft 6 is connected to the output side 16 of a gearbox unit 17, to be described in detail later, and an eddy-current brake 18 which follows it in the direction of the axis S. The latter likewise serves to brake the rate of unwinding of the drum 5. Its use is preferred to that of the disc brake assembly as the application of the braking energy takes place without any wear and without any noise annoyance resulting from mechanical contact.

Alongside the arrangement comprising disc brake assembly 13, drum 5, eddy-current brake 18 and the output side 16 of the gearbox unit 17 lying between the drum 5 and the eddy-current brake 18 there are secured to the frame 1 two rotary driving devices 19, 20. Each of the rotary driving devices 19, 20 has a direct current electric motor 21, 22, of which the output shaft is secured respectively to the input shaft 23, 24 of a change-speed gearbox 25, 26.

The change-speed gearboxes 25, 26 take the form of those of a kind known for use in lifting gear and they will not be described within the framework of the present description. The rotary driving devices 19, 20 are arranged spatially in such a way that the output shafts 27, 28 of the change-speed gearboxes 25, 26 point towards one another and the axes of rotation T, T' of the output shafts 27, 28 lie on a common straight line. Both output shafts 27, 28 are connected to the input side 29 of the gearbox unit 17 and act on a gearwheel, not visible in the drawing, which is connected to the drum shaft 6 through an idler pinion 30 to a gearwheel, likewise not shown, provided at the output side 16 of the gearbox unit 17. The gearbox assembly 17 thus serves to transmit torques between the output shafts 27, 28 of the change-speed gearboxes 25, 26 and the drum shaft 6. When the flexible tension means 4 are to be wound up on the drum 5 the rotary driving devices 19, 20 drive the drum shaft 6, and in the case of unwinding of the flexible tension means 4 from the drum 5 the necessary braking of the drum 5 can likewise take place through the direct current motors 21, 22, which then behave as generators. As the kinetic energy of the rotating drum is thereby converted into electrical energy, it can be recovered in this way, if desired, by feeding it back.

The significant advantage of coupling the output shafts 27, 28 of the gearboxes 25, 26 to the drum shaft 6 through the gearbox units 17 containing toothed pinions is the fact that the lifting gear according to the invention can operate in the so-called four-quadrant mode. What is meant by four-quadrant operation is that both in lifting and also in lowering of the load on the flexible tension means 4 the drum 5 can be both accelerated and also braked using the rotary driving devices 19, 20.

The change-speed gearboxes 25, 26 are equipped with a safety clutch, not visible in the drawing, which in the event of overloading of the respective driving direct current motor 21, 22 automatically selects the lowest gear ratio between the input shafts 23, 24 and the output shafts 27, 28, in order to minimise the torque exerted by the electric motors 21, 22 in this condition. The safety clutch is designed so that in this "first" gear a spring-force-induced action prevents release of the clutch independently of the hydraulic pressure present by which the clutch is actuated, and thereby the transmission of torque from the input shafts 23, 24 to the output shafts 27, 28 is maintained. Furthermore, in the lifting gear according to the invention there is preferably incorporated a follow-up device, not shown in the drawing, which is designed to raise and lower the drilling equipment even during the drilling operation and which the sets the engaging force of the drilling equipment on the floor of the bore hole to a desired value. For this purpose the follow-up device can be operated in the three different ways listed below:

a) "constant load", i.e. the follow-up device detects the force with which the drilling equipment engages the floor of the bore hole and adjusts it to a predetermined value;

b) "constant speed", i.e. the follow-up of the drilling equipment takes place at constant speed and c) "constant mud pressure", i.e. the follow-up speed is adjusted so that the pressure of the flushing liquid for a driving motor of the drilling equipment driven by the flushing liquid during the extraction process is constant.

The lifting gear according to the invention is furthermore equipped with a double filter installation, not visible in the drawing, by which the hydraulic oil needed for operation of the hydraulically driven components of the lifting gear, for example the disc brake assembly 13 and the change-speed gearboxes 25, 26, is effectively filtered. The two filters of this double filter installation are introduced alternately and independently of one another into flow branches capable of being switched into the hydraulic circuit. In this way the result is that—as soon as the filtering capacity is exhausted in one of the two filters—a change over to the other filter can be effected without interrupting operations.

| | |
|---|---|
| 1 | frame |
| 2 | beams |
| 3 | horizontal surfaces |
| 4 | flexible tension means |
| 5 | drum |
| 6 | drum shaft |
| 7 | longer side |
| 8 | bearing block |
| 9 | bearing block |
| 10 | end face |
| 11 | end face |
| 12 | disc |
| 13 | disc brake assembly |
| 14 | brake caliper |
| 15 | brake caliper |
| 16 | output side |
| 17 | gearbox unit |
| 18 | eddy current brake |
| 19 | rotary driving device |
| 20 | rotary driving device |
| 21 | direct current motor |
| 22 | direct current motor |
| 23 | input shaft |
| 24 | input shaft |
| 25 | change-speed gearbox |
| 26 | change-speed gearbox |
| 27 | output shaft |
| 28 | output shaft |
| 29 | input side |
| 30 | idler pinion |
| 100 | lifting gear |
| S | axis |
| T,T' | axes of rotation |
| G | straight line |

What is claimed is:

1. Lifting gear for raising and lowering a load with flexible tension means (4) attached to the load, with a drum (5) mounted to rotate about an axis (S) for winding up the tension means (4), with a first rotary driving device (19), which incorporates a first rotary driving motor (21) acting on the drum (5) through a first change-speed gearbox (25), by which the drum (5) is driven in rotation at will in the direction for winding-up or unwinding the tension element (4), wherein the first rotary driving device (19) is mounted alongside the drum (5) in relation to the axis of rotation (S) of the drum (5) in such a way that the drum (5) and the rotary driving device (19) overlap in a projection perpendicular to the axis of rotation (S) of the drum (5), the drum (5) being secured to a rotatably mounted drum shaft (6), the drum shaft (6) being coupled at one end to a mechanically acting braking device and at the other end to an electromagnetically acting braking device, and with a second rotary driving device (20) complete with a second rotary driving motor (22) and a second change-speed gearbox (26).

2. Lifting gear according to claim 1, wherein the driving shaft of the rotary driving motor (21) and the input and output shafts (23, 27) of the change-speed gearbox (25) are arranged to lie on a common straight line (G).

3. Lifting gear according to claim 1, wherein the drum shaft (6) is connected to the output side (16) of a gearbox unit (17), of which the input side (29) is coupled to the output shaft (27) of the change-speed gearbox (25).

4. Lifting gear according to claim 3, wherein the gearbox unit (17) is a toothed pinion gearbox, which has an idler pinion (30) for bridging the gap between the output shaft (27) of the change-speed gearbox (25) and the drum shaft (6).

5. Lifting gear according to claim 1, wherein the mechanically acting braking device is a disc brake assembly (13), and the electromagnetically acting braking device is an eddy-current brake (18).

6. Lifting gear according to claim 1, wherein the driving shaft of the second rotary driving motor (22) and the input and output shafts (24, 28) of the second change-speed gearbox (26) of the second rotary driving device (20) are arranged to lie on a common straight line (G).

7. Lifting gear according to claim 6, wherein the first and second rotary driving devices (19, 20) are arranged in such a way that the output shafts (27, 28) of the change-speed gearboxes (25, 26) point towards one another and have a common axis of rotation, the output shafts (27, 28) being coupled to the input side (29) of the gearbox unit (17).

8. Lifting gear according to claim 7, the second rotary driving device (20) is arranged, in relation to the direction of the axis of rotation (S) of the electromagnetically acting braking device, alongside this braking device.

9. Lifting gear according to claim 1, wherein the change-speed gearbox (24, 26) is fitted with a safety device which, when a maximum permitted torque at the input shaft is exceeded, automatically changes gear to the gear ratio giving greatest ratio of the speed of the input shaft to the speed of the output shaft.

* * * * *